US010045570B2

(12) United States Patent
Hoeven

(10) Patent No.: US 10,045,570 B2
(45) Date of Patent: Aug. 14, 2018

(54) BRA WITH MORPHOLOGICALLY ADAPTIVE CUPS

(71) Applicant: Hanes Operations Europe SAS, Rueil Malmaison (FR)

(72) Inventor: Manon Turlan-Van Der Hoeven, Marmagne (FR)

(73) Assignee: Hanes Operations Europe SAS, Rueil-Malmaison (FR)

( * ) Notice: Subject to any disclaimer, the term of this patent is extended or adjusted under 35 U.S.C. 154(b) by 157 days.

(21) Appl. No.: 14/915,882

(22) PCT Filed: Sep. 1, 2014

(86) PCT No.: PCT/FR2014/052151
§ 371 (c)(1),
(2) Date: Mar. 1, 2016

(87) PCT Pub. No.: WO2015/028762
PCT Pub. Date: Mar. 5, 2015

(65) Prior Publication Data

US 2016/0198774 A1 Jul. 14, 2016

(30) Foreign Application Priority Data

Sep. 2, 2013 (FR) ..... 13 58387

(51) Int. Cl.
*A41C 3/00* (2006.01)

(52) U.S. Cl.
CPC ..... *A41C 3/0028* (2013.01); *A41C 3/00* (2013.01); *A41B 2500/10* (2013.01); *A41C 3/0014* (2013.01); *A41C 3/0085* (2013.01)

(58) Field of Classification Search
CPC ..... A41C 3/00; A41C 3/0057; A41C 3/0028; A41C 3/144; A41C 3/14; A41C 3/0085; A41C 3/0035; A41C 3/065
(Continued)

(56) References Cited

U.S. PATENT DOCUMENTS 6,299,505 B1 * 10/2001 Huang ..... A41C 3/144 450/57
6,540,585 B1 * 4/2003 Lee ..... A41C 3/0085 2/267
(Continued)

FOREIGN PATENT DOCUMENTS

CN 2662674 12/2004
CN 201911311 8/2009
(Continued)

OTHER PUBLICATIONS

Japanese Patent Office, Notice of Reason for Rejection, Japanese Application No. 2016-537365, dated Mar. 28, 2017, 8 pages.
Korean Patent Office, Office Action, Korean Application No. 10-2016-7008563, dated Apr. 12, 2017, 14 pages.
Canadian Intellectual Property Office, Notice of Requisition by the Examiner, dated Nov. 9, 2016, 2 pages.
(Continued)

*Primary Examiner* — Gloria Hale
(74) *Attorney, Agent, or Firm* — Fish & Richardson P.C.

(57) ABSTRACT

The disclosure relates to a bra comprising two cups for accomodating the breasts of a user in which each cup is constituted by a piece of extensible textile material in the form of a substantially planar sheet when the bra is not worm, wherein a major part of the surface of the sheet is cut along a plurality of notches with a limited length arranged all around an inner part of the sheet in such a manner as to form a reversibly deformable structure suitable for being deployed to the front in a direction substantially transversal to the plane of the sheet under the effect of the weight of the breasts when the bra is being worn, causing this sheet to assume a volume conforming to the shape of the breasts and capable of supporting the breasts.

18 Claims, 2 Drawing Sheets

(58) Field of Classification Search
USPC ..... 450/36, 37, 39, 54–57
See application file for complete search history.

(56) References Cited

U.S. PATENT DOCUMENTS

| | | | | |
|---|---|---|---|---|
| 8,657,643 | B2 * | 2/2014 | Perez | A41C 3/0035 450/36 |
| 2004/0224603 | A1 * | 11/2004 | Kaye | A41C 3/0085 450/1 |
| 2006/0252342 | A1 * | 11/2006 | Davis | A41C 3/065 450/41 |
| 2011/0143633 | A1 * | 6/2011 | Zhang | A41C 3/14 450/39 |

FOREIGN PATENT DOCUMENTS

| | | | |
|---|---|---|---|
| DE | 202004008986 | U1 | 10/2005 |
| EP | 1747731 | A2 | 1/2007 |
| JP | S5058926 | U | 5/1975 |
| JP | 2007167096 | A | 7/2007 |
| JP | 2009179891 | A | 8/2009 |
| JP | 201383026 | A | 5/2013 |

OTHER PUBLICATIONS

Australian Government IP Australia, Patent Examination Report No. 1, Patent Application No. 2014313986, dated Jul. 22, 2016, 3 pages.

PCT International Search Report and Written Opinion of International Searching Authority, PCT/FR2014/052151, dated Dec. 15, 2014, 12 pages.

The State Intellectual Property Office of the People's Republic of China, Notification of the First Office Action, Chinese Application No. 201480048291X, dated Jul. 19, 2016, 6 pages.

Mexican Office Action in Mexican Application No. MX/a/2016/002768 dated May 22, 2017, 12 pages. (with English translation).

Canadian Office Action in Canadian Application No. 2922759, dated Oct. 11, 2017, 3 pages.

Korean Patent Office, Office Action, Korean Application No. 10-2016-7008563, dated Nov. 8, 2017, 8 pages. (with English translations).

European Search Report in European Application No. 17185401, dated Jan. 25, 2018, 8 pages (with English Translation).

Canadian Office Action in Canadian Application No. 2922759, dated Jan. 8, 2018, 4 pages.

* cited by examiner

BRA WITH MORPHOLOGICALLY ADAPTIVE CUPS

TECHNICAL FIELD

The present disclosure relates to the area of textile articles and more particularly that of bras.

BACKGROUND

A bra classically comprises two cups for accommodating the breasts of a user, connected to one another by an intermediate part. A back is fixed to a lateral edge of its cup and comprises means for fixing it to the other back so that the bra is held in place on the user. Moreover, a bra strap connects the upper edge of its cup to the back and extends from the lateral edge of this cup.

Bras are known of the type provided with cups that each have a flexible shell conformed in such a manner as to have a concave, substantially hemispherical shape intended to surround the breasts of the user. However, the breasts of the user can have a substantially different morphology, which means that no bra is in reality perfectly adapted to the morphology of the two breasts. Furthermore, the morphology or the volume of the user's chest can vary substantially over time. The bra can then prove to be temporarily uncomfortable for its user.

SUMMARY

Therefore, the disclosure has the goal of proposing a bra without the previously cited disadvantages. In particular, the goal of the present disclosure is to propose a bra that can adapt perfectly to the morphology of the chest and that can also ensure a good hold of the chest without exerting excessive pressure on it.

The disclosure also relates to a bra comprising two cups connected to one another, intended to accommodate the breasts of a user and connected by their respective lateral edge to a part of the back and by their respective upper edge to a strap joining the corresponding part of the back, characterized in that each cup is constituted by an extensible piece of textile material in the form of a substantially planar sheet when the bra is not being worn, and that a major part of the sheet surface is cut along a plurality of notches of a limited length arranged all around an inner part of the sheet so as to form a reversibly deformable structure suitable for being deployed towards the front in a direction essentially transverse to the plane of the sheet under the effect of the weight of the breasts when the bra is being worn, causing this sheet to assume a volume conforming to the shape of the breasts and capable of supporting the breasts.

The present disclosure is therefore based on making a cup which is flat when the bra is not being worn assume a volume which is capable of deforming under the effect of the weight of the breasts substantially in one direction toward the front of the chest due to the presence of appropriate cuts made in the sheet of textile material constituting the cup. Once this has been done, the disclosure appropriates a technique of cutting and changing the volume of paper known under the name of "kirigami" in order to adapt it in a surprising and especially advantageous manner to the textile area and in particular to that of bras. In fact, due to an appropriate arrangement of the notches made flatly in the sheet of textile material constituting the cups, the latter, which are present in a substantially planar shape when the bra is not worn, "open up" under the effect of the weight of the breasts when the bra is worn in a favored one direction aimed to the front of the chest while surrounding the breasts in such a manner that the bra is applied more harmoniously and more comfortably to the user's bust, perfectly adjusted to the morphology of the user's breasts, which offers a holding without excessive stress on the chest.

Furthermore, the holding structure of the breasts openworked in this manner allows the skin to breathe freely, which increases even more the comfort of the wearer. In addition, by virtue of this construction which allows the cups to be flat in the non-worn state of the bra in accordance with the disclosure, the latter is made not very voluminous, for example, as compared to cups that are hot-molded and classically present a substantially and partially hemispheric concave shape. Finally, in addition to its technical function of holding the breasts, the openwork structure of the cups once they are deployed in the worn state of the bra creates a remarkable aesthetic effect which can vary as a function of the shape and the orientation selected for the notches.

The notches are advantageously arranged periodically in the sheet plane.

According to an embodiment at least a part of the notches can be arranged in accordance with a network of curved lines constituted by two symmetrical sets of lines extending respectively on each side of a longitudinal axis of a respective cup.

The sheet can advantageously comprise a succession of notches arranged according to a plurality of concentric, circular lines extending at least into the lower part of a respective cup.

The sheet advantageously comprises notches extending substantially vertically at least in the proximity of the upper edge of a respective cup.

The notches preferably have a rectilinear or substantially curved shape.

The notches advantageously have a maximum length comprised between 10 and 20 millimeters.

The notches are advantageously spaced at least 1 millimeter from each other, preferably from 1 to 5 millimeters.

According to an embodiment the sheet can have supplementary cuts made along an ornamental pattern and are advantageously arranged in the upper part of a respective cup and/or in its lower part.

The piece of textile material is preferably made of monolayer or multi-layer knit fabric based on polyamide and elastane, advantageously with an elongation at 15 newtons comprised between 10% and 80% at least in one direction and with high responsiveness (e.g., springback).

The knit fabric preferably has a weight comprised between 250 and 400 g/m$^2$.

According to an embodiment each cup is lined with a fine knit, elastic lining fixed peripherally on the cup.

The lining is advantageously made with a light mesh on the order of 60 g/m$^2$ with an elongation at 15 newtons at least equal to 130% in length and/or in width and equal to or greater than 240% at least in one direction.

BRIEF DESCRIPTION OF DRAWINGS

Other particularities and advantages of the disclosure will be apparent from a reading of the description given below of a particular embodiment of the disclosure given by way of a non-limiting example with reference made to the attached drawings in which.

DETAILED DESCRIPTION

Figure 1:
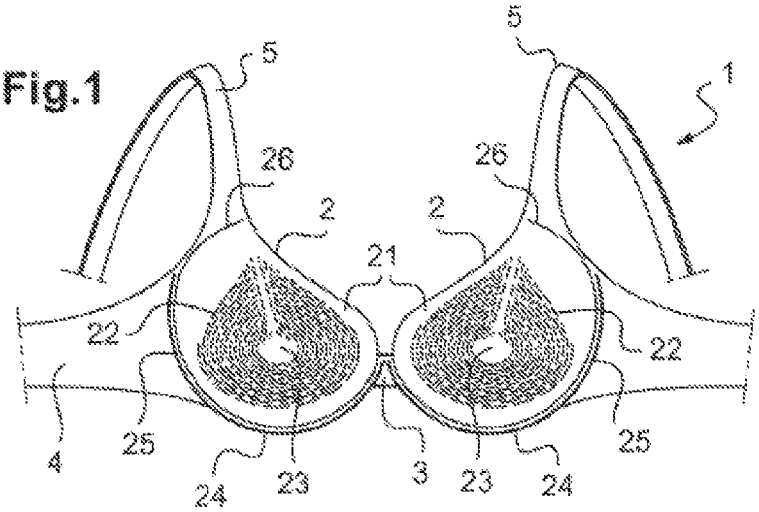
FIG. 1 is a schematic view illustrating an example of a bra in conformity with the disclosure in a non-worn state.

FIG. 1 illustrates an example of a bra 1 in accordance with the disclosure. This bra comprises two cups 2 for accommodating the breasts of a user and are connected to one another on their inner side by a central intermediate part 3. Each cup 2 has the shape of a sheet 21 of substantially planar textile material when the bra is not being worn. Furthermore, each cup 2 can be advantageously fixed in its lower part to a rigid underwiring 24, while it is understood that the disclosure can also be applied to bras without underwiring that are called "soft", or also to the bandeau type. In the example illustrated the underwiring 24 extends along a lower edge to a lateral edge 25 of a cup and comprises fixation means (not shown) on the other back part. A strap 5 joins the upper edge 26 of a cup 2 to the corresponding part of back 4.

As schematically illustrated in FIG. 1, each sheet 21 of textile material, that can be a mono-layer or multi-layer (a complex of several materials assembled by thermal adhesion, for example) sheet, comprises in the sheet plane over a major part of its surface a plurality of notches 22 or slots, substantially linear, traversing the entire thickness of the sheet 21 and arranged entirely around an inner part 23 of the sheet 21 free of notches and preferably with a discoidal (circular surface) shape or ellipsoidal (oval surface) shape. The inner part 23 free of notches 22 preferably forms a substantially central part of the sheet constituting the cup and can be advantageously off-center toward the inner side of the cup (toward the central part of the bra) so as to achieve an effect of bringing the breasts closer to one another. Furthermore, the surface occupied by the inner part 23 free of notches 22 is a function of the selected dimension of the notches 22. Therefore, the smaller the notches, the greater the surface occupied by the inner part 23.

The notches 22, by virtue of their shape, dimension and appropriate orientation in the sheet plane, are intended to allow an extension of the sheet 21 in a direction substantially transverse to the sheet plane, that is, in the direction pointing to the front of the chest while preserving a certain rigidity of the sheet in directions transverse to the chest under the effect of the weight of the breasts when the bra is worn. In other words, the sheet 21 openworked in this manner by the notches 22 constitutes a reversibly deformable holding structure suitable for being deployed to the front, permitting and ensuring a substantially hemispheric change of the volume of a respective cup of the bra in the direction pointing to the front of the chest under the effect of the breasts when the bra is worn, and suitable for being able to be folded in order to return to a substantially planar configuration when the bra is not being worn.

The shape of the sheet depends on the shape and the size of the bra for which it is provided but it is preferably in an elongated, substantially elliptical shape and more particularly in the shape of a tear (e.g., teardrop) with a major axis extending between the upper edge of the cup and the lower edge of a respective cup, for example, comprised between 100 mm and 160 mm, and a minor axis extending between the lateral edges of a respective cup, for example comprised between 50 mm and 130 mm. For example, as depicted in FIGS. 1-4, a majority of the sheet 21 includes the plurality of notches 22 arranged around an inner part 23 of the sheet 21 in the shape of a tear, where a lower portion of the tear shape is generally circular and an upper portion of the tear shape is generally triangular.

The notches 22 preferably have a maximum length comprised between approximately 10 mm and 20 mm, preferably approximately 15 mm and are arranged periodically in the plane of the sheet 21, preferably following a network of lines extending all around the inner part 23 of the sheet 21. In a general manner the notches 22 are spaced among themselves in all directions of the sheet plane by at least 1 millimeter, preferably from 1 mm to 5 mm and advantageously 3 mm.

In addition to the shape and the arrangement of the notches 22 in the plane of the sheet 21, the textile material of the sheet also greatly influences the opening and the change in volume of the latter under the effect of the weight of the breasts when the bra is worn. The sheet 21 of textile material is advantageously made of mono-layer or multi-layer (several knit fabrics assembled in a complex by thermal adhesion, for example) knit fabrics based on polyamide and elastane (preferably approximately 40% by weight elastane relative to the total weight of the knit fabric). It advantageously has an elongation at 15 newtons comprised between 10% and 80% at least in one direction. The specific weight of the knit fabric is advantageously comprised between 250 and 400 g/m$^2$. Furthermore, it advantageously has a very high responsiveness (e.g., springback), indicated by the characteristics in terms of force up to 30% of elongation preferably comprised between 700 and 900 cN. Due to this fact the material perfectly accompanies the morphology of the breasts and favors the return of the sheet 21 into a substantially planar configuration when the bra is not worn.

Different variants of the arrangement of the notches 22 will now be described according to different patterns in the plane of the sheet 21 when flat, allowing the obtention of an extension of the sheet 21 in a direction aimed at the front of the chest for a change in volume of the sheet 21 in a substantially hemispheric shape suitable for holding the breast when the bra is being worn.

Figure 2:
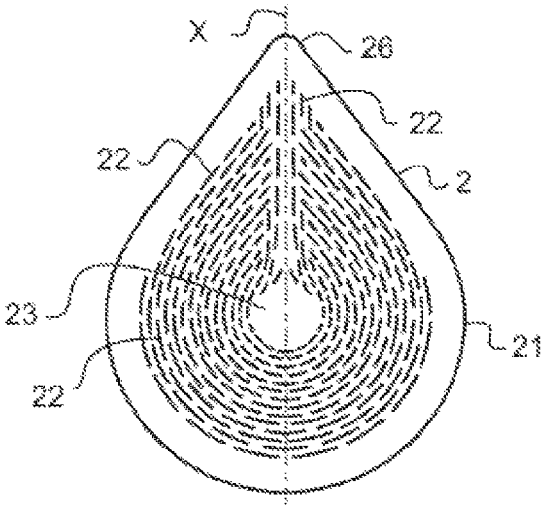
FIGS. 2 to 4 show examples of sheets of textile material for forming the cups of the bra in accordance with the disclosure with different variants of embodiments of the notches.

In the particular embodiment illustrated in FIG. 2 the majority of the notches 22 is arranged in the plane of the sheet 21 in accordance with a network of curved lines, preferably equidistant and parallel to each other, constituted by two symmetrical sets of lines extending respectively on each side of a longitudinal axis X passing through the substantially central inner part 23 of the sheet 21.

In the lower median part of the sheet 21 of textile material constituting a respective cup 2 the plurality of successive notches 22 arranged in line advantageously form a plurality of concentric circular lines extending from the edges of the cup 2 and approaching the substantially central inner part 23 of the sheet 21.

Furthermore, the sheet 21 advantageously comprises vertical notches 22 at the top part of a respective cup 2 at least in the proximity of the upper edge 26 of the cup which can be aligned vertically in the form of several vertical lines extending from the substantially central inner part 23 toward the upper edge 26 of the cup. This vertical arrangement of the notches in the respective top part of a cup 2 is preferable in order to allow the cup to rest substantially flat in this upper part after extension when the bra is worn.

Figure 5:
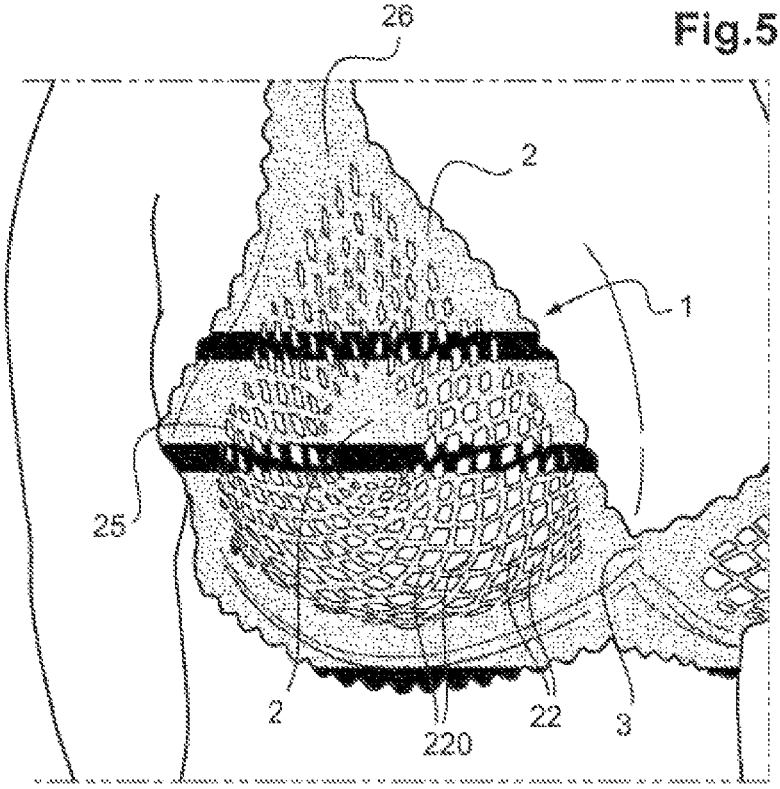
FIG. 5 shows an example of a bra in conformity with the disclosure in the worn state.

This particular embodiment of the cups is illustrated in the worn state of the bra 1 in FIG. 5. When the bra 1 is worn by a user, the notches 22 open under the effect of the weight of the breasts, allowing the sheet 21 to deploy toward the front in a direction substantially transverse to the plane of the sheet 21, conforming to the shape of the breasts and the textile material between the notches 22 which are therefore open extends, forming a network of crossed lines 220 constituted by the material between the notches 22 suitable for maintaining the breasts and extending from the edges of the cup toward the central zone 23 projected forward under the effect of the weight of the breasts.

Figure 3:
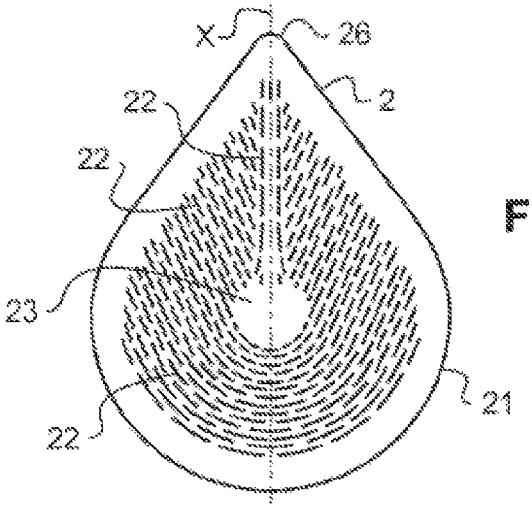

According to the variant of FIG. 3, in the upper median part of the sheet 21 the notches 22 constitute two sets of oblique lines arranged in distinct and symmetrical directions in the plane of the sheet 21 relative to the axis X, extending radially from the substantially central inner part 23 toward the edges of a respective cup 2. It turns out that this arrangement of the notches 22 in the upper median part of the sheet 21 allows the obtention of a deforming configuration of the cups 2 that is particularly adapted for the sides of the bra, that is, on the side of the lateral edge 25 of the cups whereas the arrangement of the notches 22 in the upper median part of the sheet 21 such as described with reference made to FIG. 2 is particularly adapted for the center of the bra, that is, on the inner side of the cups.

Figure 4:
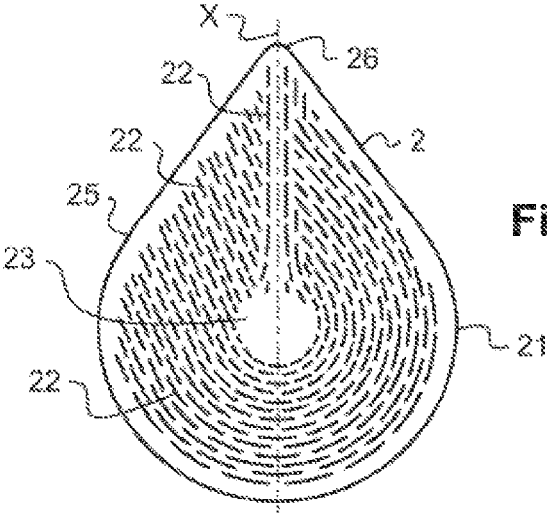

Also, the variant the FIG. 4 illustrates a combination of two previous embodiments and concerns the arrangement of the notches 22 in the upper median part of the sheet 21 which repeats the arrangement of FIG. 3 on the side of the lateral edge 25 of the respective cup 2 and that of FIG. 2 on the inner side of the cup 2.

However, whatever the embodiment is, it is advisable to arrange the vertical notches in the upper part of a respective cup 2 as explained referring to FIG. 2. The shape of the notches is preferably substantially curved, which notches are arranged along curved lines and rectilinear in vertical notches or those arranged along oblique lines. Furthermore, supplementary cuts made in accordance with an ornamental pattern can be advantageously arranged in the upper part of the cup and/or in the substantially central lower part 23 to the extent that when arranged in this manner, such cups do not open very much when the bra is worn.

According to an embodiment each cup 2 can be lined with a fine, knit elastic lining (not shown) provided for being applied preferably on the entire outer face of a respective cup 2 and which is preferably fixed peripherally to the outer face of a respective cup 2. As a variant the cup can be lined with the fine elastic lining on the side of its inner face. According to an exemplary embodiment such a lining can be made of simple material, preferably with a light mesh on the order of 60 g/m$^2$ and has an elongation at 15 newtons at least equal to 130% (comprised between 180% and 360% and beyond) in length and/or in width and equal to or greater than at least 240% in one of the two directions. Furthermore, it has a high responsiveness (e.g., springback), advantageously allowing it to not "go baggy" after extension.

The invention claimed is:

1. A bra comprising two cups connected to one another, configured to accommodate breasts of a user and connected by their respective lateral edge to a part of a back of the bra and by their respective upper edge to a strap joining a corresponding part of the back, wherein each cup comprises an extensible piece of textile material in the form of a sheet that is substantially planar when the bra is not being worn, the sheet defining a plane when the bra is not being worn, and a majority of the sheet includes a plurality of notches arranged around an inner part of the sheet in the shape of a tear so as to form a reversibly deformable structure suitable for being deployed towards a front of the bra in a direction essentially transverse to the plane of the sheet under a weight of the breasts when the bra is being worn, causing the sheet to assume a volume conforming to a shape of the breasts and capable of supporting the breasts, where the shape of the tear comprises a lower portion that is generally circular and an upper portion that is generally triangular; and wherein the sheet comprises a subset of notches of the plurality of notches, the subset of notches extending substantially vertically at least proximate to the upper edge of a respective cup about a longitudinal axis, the longitudinal axis extending from a central inner part of the respective cup to the upper edge of the respective cup.

2. The bra according to claim 1, wherein the plurality of notches are arranged periodically in the plane of the sheet.

3. The bra according to claim 1, wherein at least a part of the plurality of notches is arranged in an upper median part of the sheet in accordance with a network of lines constituted by two symmetrical sets of oblique lines extending respectively on each side of the longitudinal axis of a respective cup.

4. The bra according to claim 1, wherein the sheet comprises a succession of notches of the plurality of notches arranged according to a plurality of concentric, circular lines extending at least into a lower part of a respective cup.

5. The bra according to claim 1, wherein the plurality of notches have a rectilinear or substantially curved shape.

6. The bra according to claim 1, wherein each notch in the plurality of notches have a maximum length comprised between 10 and 20 millimeters.

7. The bra according to claim 1, wherein the plurality of notches are spaced at least 1 millimeter from each other.

8. The bra according to claim 1, wherein the sheet includes supplementary cuts made along a pattern arranged in an upper part of a respective cup and/or in a lower part of the respective cup.

9. The bra according to claim 1, wherein the piece of textile material is made of mono-layer or multi-layer knit fabric comprising polyamide and elastane, with an elongation at 15 newtons comprised between 10% and 80% at least in one direction.

10. The bra according to claim 9, wherein the knit fabric has a weight comprised between 250 and 400 g/m2.

11. The bra according to claim 1, wherein each cup is lined with a fine knit, elastic lining fixed peripherally on the cup.

12. The bra according to claim 11, wherein the lining is made with a mesh having a weight of 60 g/m2 with an elongation at 15 newtons at least equal to 130% in length and/or in width and equal to or greater than 240% at least in one direction.

13. The bra according to claim 7, wherein each notch the plurality of notches are spaced from each other at a distance from 1 to 5 millimeters.

14. The bra according to claim 3, wherein the sheet comprises a succession of notches of the plurality of notches arranged according to a plurality of concentric, circular lines extending at least into a lower part of a respective cup.

15. The bra according to claim 14, wherein the sheet includes supplementary cuts made along a pattern arranged in an upper part of a respective cup or in its lower part.

16. The bra according to claim 3, wherein the plurality of notches have a rectilinear or substantially curved shape.

17. The bra according to claim 16, wherein the plurality of notches have a maximum length comprised between 10 and 20 millimeters.

18. The bra according to claim 1, wherein at least a part of the notches is arranged in an upper median part of the sheet in accordance with a network of lines constituted by two substantially parallel sets of oblique lines extending respectively on each side of the longitudinal axis of a respective cup.

* * * * *